United States Patent [19]

Tsushima et al.

[11] Patent Number: 4,749,638

[45] Date of Patent: Jun. 7, 1988

[54] ELECTROPHOTOGRAPHIC TONER COMPOSITION

[75] Inventors: Rikio Tsushima, Wakayama; Yukihiro Fukuyama, Naka; Kazunari Takemura, Wakayama; Yutaka Yasuda, Kaizuka, all of Japan

[73] Assignee: KAO Corporation, Tokyo, Japan

[21] Appl. No.: 859,037

[22] Filed: May 2, 1986

[30] Foreign Application Priority Data

| | | | |
|---|---|---|---|
| May 8, 1985 | [JP] | Japan | 60-97553 |
| May 8, 1985 | [JP] | Japan | 60-97552 |
| May 8, 1985 | [JP] | Japan | 60-97554 |
| May 8, 1985 | [JP] | Japan | 60-97555 |

[51] Int. Cl.[4] ..... G03G 9/08

[52] U.S. Cl. ..... 430/109; 430/137

[58] Field of Search ..... 430/137, 109; 524/745, 524/750, 718, 720, 739

[56] References Cited

U.S. PATENT DOCUMENTS

| | | | |
|---|---|---|---|
| 4,476,210 | 10/1984 | Croucher et al. | 430/137 |
| 4,486,559 | 12/1984 | Murata et al. | 430/137 |
| 4,592,990 | 6/1986 | Takagi et al. | 430/137 |

*Primary Examiner*—John L. Goodrow

*Attorney, Agent, or Firm*—Birch, Stewart, Kolasch & Birch

[57] ABSTRACT

An electrophotographic toner composition, improved in uniform dispersion therein of carbon black and electrophotographic properties, comprises a binder polymer, carbon black and a compound selected from the group consisting of a sulfonate compound having the formula (I), an alkaline earth metal salt of a basic alkylphenol persulfide having the formula (II), an alkyl or alkenyl succinic acid imide having the formula (III-1) or (III-2), an alkyl salicylic acid salt having the formula (IV), a compound having the formula (V) and a product obtained by treating the compound (V) with sulfur, in which R, R', R1 and R2 are a substituent and M is an alkaline earth metal.

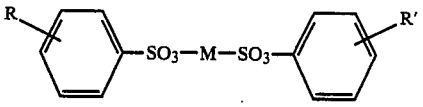

(I)

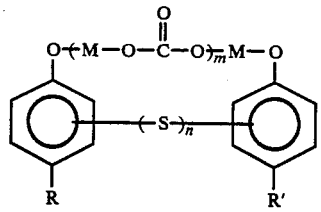

(II)

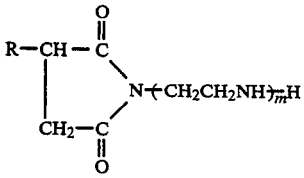

(III-1)

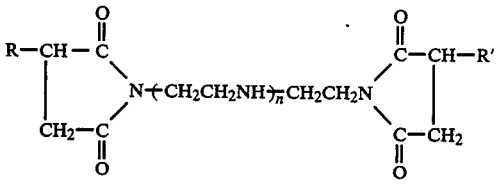

(III-2)

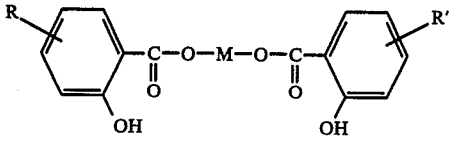

(IV)

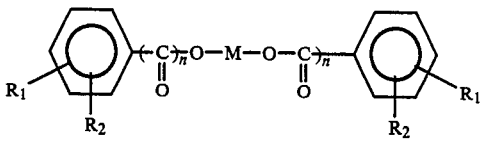

(V)

8 Claims, No Drawings

ELECTROPHOTOGRAPHIC TONER COMPOSITION

The invention relates to a process for preparing an electrophotographic toner composition and the composition per se. Which is useful in the electrophotographic method, the electrostatic recording method and the electrostatic printing method.

The developing process using dry toners mainly composed of a coloring agent and a resin includes:

(i) two-component development, in which dry toners are blended with carriers having a larger particle size than that of the toners to apply electric charges at a polarity opposite to that of the charges in the electrostatic latent images to the toners by the triboelectric charging, and then developing the developer as a mixture of the toners and the carriers while being in contact with electrostatic latent images to thereby develop the static latent images, and (ii) one-component development, in which toners containing magnetic material are in contact with or brought closer to static latent images for development.

STATEMENT OF PRIOR ART

Heretofore, these toners have been prepared by melting a thermoplastic resin, adding thereto and well mixing therewith a coloring agent such as dye or pigment and, optionally, magnetic material, triboelectric charge control agent, anti-offset agent, lubricant, etc and then cooling to solidify them, which are finely pulverized and then classified in order to obtain a required particle size.

However, the foregoing method involves various drawbacks. At first, apparatus relevant to a number of steps are required, such as a polymerizing device for the production of resin, apparatus for kneading, pulverizer and classifier, which require a number of steps and a great amount of energy is consumed which increases the production cost. Secondly, no homogenous mixture can be obtained with ease in the kneading step and, particularly, the conditions for the homogenous dispersion are delicate. Thirdly, since both a fine powder of a particle size having a suitable range to obtain clear images without fogging and the undesired finer and coarser particles are also produced in the pulverization step, the foregoing method requires complicated steps such as a classification for removing the undesired particles. Furthermore the yield upon obtaining particles of a desired range is poor which leads to an increased cost. Lastly, the resultant powder has an amorphous shape due to the pulverization causing the fogging in the images due to the poor fluidity of the fine powder and the fine powder resulted from the pulverization under stirring upon triboelectric charging.

In view of the above, toner production processes by way of suspension polymerization have been disclosed in Japanese Patent Publications Nos. 36-10231, 47-518305 and 51-14895, etc. Since the suspension polymerization process requires no pulverization and the production step therefor is simplified, the foregoing defects can be improved. However, there are still problems attendant to the suspension polymerization.

That is, the dry toners are mainly composed of a thermoplastic resin and admixed with those materials for providing them with various improving functions, such as a coloring agent, for example, a dye and a pigment, a charge controlling agent for improving the triboelectric charging property, a magnetic material for providing the deposition property to the developing roller, an anti-offset agent for preventing the toners from depositing to the fixing roller, and a toner fluidity improver, etc. If these materials are uniformly dissolved in the polymerizable monomer and do not hinder the polymerizing reaction, no particular problems occur. However, since most of the materials to be added are insoluble or less soluble to the polymerizable monomer and lack in the affinity with the polymerizable monomer, it is difficult to cause these materials to be present in a uniform state in the polymer particles. If the affinity of the added materials to the polymerizable monomer is significantly poor, they sometimes transfer to the aqueous phase during polymerization and are not present in the toner particles.

In this way, since the added materials are present unevenly in the proper toners, the function of the toners can not be attained completely and insufficient charging for example, may result.

Referring particularly, the carbon black used as the coloring agent or charge controlling agent, although oleophilic, is as fine as from 10 to 30 mμ in the stage of primary particles and, moreover, it forms primary coagulates and secondary coagulates in a further advanced coagulation stage upon production. Therefore, carbon black is difficult to be dispersed in the polymerizable monomer merely by dispersing means such as a ball mill. The toner particles containing insufficiently dispersed carbon black reduces the blackness of the toners thereby failing to obtain black images, and increase the scattering in the electric resistance and the amount of the triboelectric charges of the toner particles resulting in poor image quality.

SUMMARY OF THE INVENTION

The object of this invention is to provide toners improved over the foregoing defects, as well as a method of manufacturing them. Specifically, the first object of this invention is to provide toners having carbon black sufficiently dispersed and capable of obtaining an excellent image. The second object thereof is to provide a method of producing toners improving the defects in the suspension polymerization process.

The invention provides a process for preparing an electrophotographic toner composition and a toner composition per se. The composition comprises a binder polymer, carbon black and a compound selected from a sulfonate compound having the formula (I), an alkaline earth metal salt of a basic alkylphenol persulfide having the formula (II), an alkyl or alkenyl succinic acid imide having the formula (III-1) or (III-2), an alkyl salicylic acid salt having the formula (IV), a compound having the formula (V) and a product obtained by treating the compound (V) with sulfur.

The sulfonate compound is represented by Formula (I):

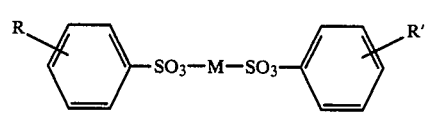

(I)

wherein R and R', which may be identical or different with each other, individually represent linear or branched alkyl groups having from 6 to 50 carbon atoms and M represents an alkaline earth metal.

The alkaline earth metal salt of a basic alkylphenol persulfide is represented by Formula (II):

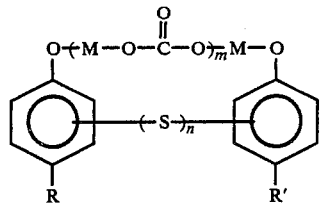

(II)

wherein R and R' which may be identical or different with each other, individually represent linear or branched alkyl groups having from 6 to 100 carbon atoms, M represents an alkaline earth metal, S represents a sulfur atom, m=0–5 and n=1–3.

The alkyl or alkenyl succinic acid imide is represented by Formulas (III-1) or (III-2):

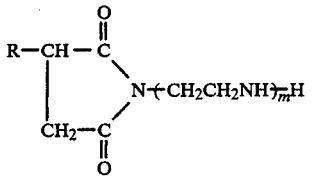

(III-1)

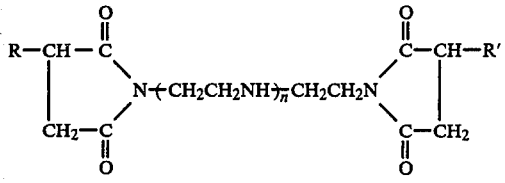

(III-2)

wherein R and R', which may be identical or different with each other, individually represent linear or branched alkyl or alkenyl groups having from 12 to 300 carbon atoms and m, n individually represent integers from 0 to 10.

The alkyl salicylic salt is represented by Formula (IV):

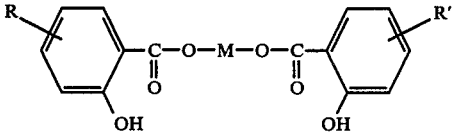

(IV)

wherein R and R' which may be identical or different with each other, individually represent linear or branched alkyl groups having from 6 to 100 carbon atoms and M represents an alkaline earth metal.

A compound is disclosed which is represented by Formula (V):

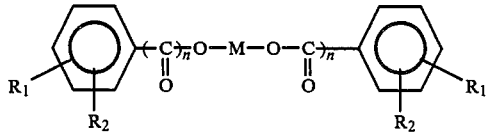

(V)

in which at least one of R1 and R2 is an aklyl group, an alkenyl group, an aryl group, an arylalkyl group or an alkylaryl group, having 1 to 32 carbon atoms, the other is hydroxy or hydrogen, n is zero or 1, and M is an alkaline earth metal or a divalent transition metal.

It is preferable that said compound has the formula (I), (II), (III-1), (III-2) or (IV). It is practical in the invention that the composition comprises 100 parts by weight of the binder and 0.01 to 10 parts by weight of said compound having the above defined formula. The toner composition preferably has a softening point of 90° to 160° C. according to a flow tester and a glass transition temperature of 50° C. or higher.

The invention further provides a process for producing a toner composition, which comprises the steps of dispersing carbon black in a monomer having polymerizable unsaturation in the presence of a compound having the formula (I), (II), (III-1), (III-2), (IV) or (V) as defined above and effecting the dispersion polymerization of the dispersion to obtain toner particles. It is also preferable that in the process the compound has the formula (I), (II), (III-1), (III-2) or (IV). The process is preferably conducted in such a condition that the compound is present in an amount of 0.5 to 10 percent by weight per the monomer. In the practical point of view, it is preferable that the process comprises the steps of preparing an oil phase dispersion from the monomer, carbon black and the compound and adding the oil phase dispersion to an aqueous phase containing therein a dispersion stabilizer, at a weight ratio of 1:2 to 1:10, to form oil drops of 5 to 30 microns.

In the above shown formulae, M is an alkaline earth metal such as calcium, magnesium, barium and zinc.

The compound having each of the above shown formulae will serve as a dispersant. It is preferable that the dispersant is used in an amount of less than 10 percent by weight, especially 0.5 to 4 wt.%, based on the weight of the used monomer, in the process for preparation of the toner.

In the process, the dispersant and carbon black are mixed and dispersed in a polymerizable monomer to prepare an oil phase which is then polymerized through the suspension polymerization process to produce polymer particles.

Upon suspension polymerization, the liquid dispersion of the oil phase as described above is added to an aqueous phase in which a suspension stabilizer such as a water soluble polymer and a less water soluble inorganic salt is uniformly dissolved or dispersed and then dispersed by a dispersion means such as a homomixer, homogenizer, etc into oil droplets from 5 to 30 μm. The weight ratio between the oil phase and the aqueous phase is set to such a range as causing no coagulation of particles during polymerization within a range from 1:2–1:10. The liquid dispersion in which the oil phase is homogeneously dispersed into the aqueous phase is transferred to a separable flask attached with an agitator, a condenser, a thermometer and a nitrogen introduction tube, warmed to a temperature at which the polymerization initiator is decomposed (50°–90° C.) and polymerization is carried out under a nitrogen atmosphere.

After the polymerization has been completed, the aqueous phase is removed by filtration and the inorganic powder, if deposited to the surface of the toners, is removed by treatment with a diluted acid. The toners are prepared by washing with water, and removing the water content by means of spray drying, vacuum drying or the like.

The basic alkyl phenol persulfide alkaline earth metal salt having the formula (II) can be synthesized. For example, an alkyl phenol is first synthesized by a reaction of an alpha-olefin having 6 to 100 carbon atoms having a double bond at the terminal end and phenol. Then, the thus obtained alkyl phenol is reacted with hydroxide of alkaline earth metal such as Ca, Mg, Ba and Zn, sulfur and gaseous carbon dioxide to obtain the desired compound of a basic alkylphenol persulfide-alkaline earth metal salt.

The alkyl or alkenyl succinic acid imide having the formulae (III-1) and (III-2) can be synthesized. For example, an alkenyl succinic anhydride is first synthesized by a reaction of an alpha-olefin oligomer and maleic anhydride. The product may be converted into an alkyl succinic anhydride, for example, by way of hydrogenating reduction, if required. The thus obtained alkyl (or alkenyl succinic acid anhydride is reacted with an imidizing agent such as ammonia or a polyalkylene polyamide, for example, ethylene diamine, diethylene triamine or triethylene tetramine to obtain a desired alkyl (or alkenyl) succinic acid imide.

The alkyl salicylic acid salt having the formula (IV) can be synthesized. For example an alkyl salicylic acid is first synthesized by a reaction of an α-olefin with 6 to 100 carbon atoms having a double bond at the terminal end and salicylic acid. Then, the thus obtained alkyl salicylic acid is reacted with hydroxide of alkaline earth metal such as Ca, Mg, Ba and Zn to obtain a desired compound of an alkyl salicylic acid salt.

In the compound represented by the general formula (V) according to this invention as described above, at least one of $R_1$ and $R_2$ in the general formula (V) is a linear or branched alkyl, alkenyl, aryl, arylalkyl and alkylaryl group with from 1 to 32 carbon atoms which may possibly have a substituent. Specifically, there can be methyl, ethyl, propyl, butyl, pentyl, heptyl, hexyl, octyl, nonyl, decyl, dodecyl, undecyl, tridecyl, tetradecyl, hexadecyl, octadecyl, eicosyl, docosyl, octacosyl, triacontyl, ethenyl, butenyl, octenyl, decenyl, tridecenyl, tetradecenyl, octadecenyl, pentacenyl, heptacosenyl, octacosenyl, nonacosenyl, triacontenyl, dodecadienyl, hexadecadienyl, octacosadienyl, 2-hexyldecyl, 2-tetradecyloctadecyl, p-nonylphenyl and benzyl groups. Further, the other of $R_1$ or $R_2$ is hydroxyl group or a hydrogen atom. "n" is 0 or 1 and M is a bivalent metal selected from alkaline earth metals such as Mg, Ca, Sr, and Ba; and bivalent transition metals such as Zn, Cu, Ni, Co, Fe, Mn, Cd, Pb, Cr and Ti.

Specific examples of the compounds represented by the general formula (V) are shown below.

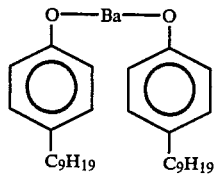

(hereinafter, simply referred to as compound (V-1))

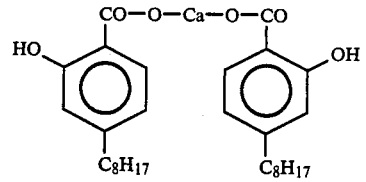

(hereinafter, simply referred to as compound (V-2))

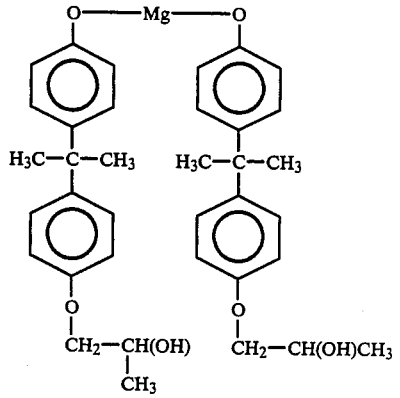

(hereinafter, simply referred to as compound (V-3))

The binder resin usable in this invention can include almost all of those resins used so far as resins for developers. For example, there can be mentioned, styrene resin, acryl resin, styrene-acryl copolymer, polyester resin, epoxy resin, styrenebudadiene resin, polyethylene resin, polypropylene resin, cumarone-indene resin and rosin resin. Among them, styrene resin can include, for example, homopolymers of styrene or styrene derivatives such as styrene, o-methylstyrene, m-methylstyrene, p-methylstyrene α-methylstyrene, p-ethylstyrene, 2,4-dimethylstyrene, p-chlorostyrene and vinyl naphthalene, or those comprising them as the main ingredient and α,β-unsaturated polymerizable monomers copolymerized therewith.

Further, as the acrylic resin, there can be mentioned, for example, those homopolymers of ethylenic monocarboxylic acids and acids thereof, for example, substituted ethylenic monocarboxylic acid such as acryronitrile, methacrylonitrile and acrylamide and they include, for example, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acryalte, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloro acrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethyl aminomethyl methacrylate and dietylaminoethyl methacrylate, or those comprising them as the main ingredient and α,β-unsaturated polymerizable monomers copolymerized therewith.

Further, the styrene-acrylic copolymer is a copolymer of the $\alpha,\beta$-unsaturated polymerizable monomer as described above, and those comprising these monomers as the main ingredient and other $\alpha,\beta$-unsaturated polymerizable monomers copolymerized therewith may be used.

Further, the styrene-butadiene resin can include those prepared by copolymerizing styrene or styrene derivative used for the preparation of the styrene resin described above with a diene compound such as butadiene, chloroprene and isoprene, or further copolymerizing it with other $\alpha,\beta$-unsaturated polymerizable monomers.

Further, those usable for the binder resin can also include homopolymers or copolymers of other $\alpha,\beta$-unsaturated polymerizable monomers, for example, ethylenic unsaturated monoolefins e.g., ethylene, propylene, butylene and isobutylene; vinyl esters e.g., vinyl chloride, vinyl bromide, vinyl fluoride, vinyl acetate, vinyl pripionate, vinyl formate and vinyl caproate; ethylenic dicarboxylic acid and substituent thereof e.g., dimethyl maleate; vinyl ketones e.g., vinyl methyl ketone; vinyl ethers e.g., vinyl methyl ether; vinylidene halides e.g., vinylidene chloride, and N-vinyl compounds e.g., N-vinyl pyrrole, N-vinyl pirrolidone.

Furthermore, the polyester resin mentioned as an example for the binder resin can be prepared by the esterifying reaction of a polybasic carboxylic acid such as dicarboxylic acid, tricarboxylic acid and tetracarboxylic acid with a polyhydric alcohol such as diol and triol, and the acid and alcohol ingredients may be used, respectively, singly or in a plurality of kinds.

The diol ingredients used for the polyester resin can include, for example, polyoxypropylene (2,2)-2,2-bis(4-hydroxyphenyl)propane, polyoxypropylene (3,3)-2,2-bis(4-hydroxyphenyl)propane, polyoxyethylene (2,0)-2,2-bis(4-hydroxyphenyl)propane, polyoxypropylene (2,0)-polyoxyethylene (2,0) 2,2-bis(4-hydroxyphenyl)-propane and polyoxypropylene (6)-2,2-bis(4-hydroxyphenyl)propane.

Further other polyols can be mentioned depending on the case, for example, polyoxypropylene (12)-2,2-bis(4-hydroxyphenyl)propane, polyoxypheylethylene (3)-2,2-bis(4-hydroxyphenyl)propane, ethylene glycol, diethylene glycol, propylene glycol, triethylene glycol, tetramethylene glycol, pentamethylene glycol, hexamethylene glycol, heptamethylene glycol, octamethylene glycol, nonamethylene glycol, decamethylene glycol, neopentylene glycol, p-xylylene glycol, m-xylylene glycol, 1,4-cyclohexane dimethanol, 1,4-cyclohexane diethanol, 1,4-cyclohexane diol, 1,3-cyclohexane dimethanol, glycerine, polyoxyethylene (6) glycerine and polyoxypropylene (12)-pentaerythritol.

Furthermore, those usable can also include N,N'-bis(-hydroxymethyl)piperazine, N,N'-bis(hydroxymethyl)-mehylpiperzine, N,N'-bis(2-hydroxypropyl)piperazine, N,N'-bis(2-hydroxypropyl)-2,5-dimethylpiperazine, N,N'-bis(2-hydroxyethyl)-2,5-dimethylpiperazine, N,N'-bis(2-hydroxy-2-methylpropyl)piperazine, N,N'-bis(2-methyl-2-hydroxynonyl)piperazine, N,N'-bis(2-hydroxy-3-methoxypropyl)piperazine, N,N'-bis(3-phenyl-2-hydroxypropyl)piperazine, N,N-bis(2-hydroxyethyl)methylamine, N,N-bis(2-hydroxyethyl)-cyclohexylamine, N,N-bis(2-hydroxypropyl)methylamine, N,N-bis(2-hydroxypropyl)isopropylamine, triethanol amine, 2-methyl-2-N,N-dimethylaminomethyl-1,3-propanediol, 2-methyl-2-N,N-diethylaminomethyl-1,3-propanediol, 2-ethyl-2-N,N-di-n-propylaminomethyl-1,3-propanediol, 2-methyl-2-N,N-di-n-butylaminomethyl-1,3-propanediol, 2-methyl-2-N,N-dimethylaminoethyl-1,3-propanediol, 2-methyl-2-piperidinomethyl-1,3-propanediol, bis(2-N,N-dimethylaminomethyl)-1,3-propanediol, bis(2-N,N-di-isopropylaminomenyl)-1,3-propanediol, 3-methyl-3-N,N-dimethylaminomethyl-1,5-pentanediol and 4-ethyl-4-N,N-di-isopropylaminomethyl-1,6-hexanediol.

Among the acid ingredients usable in the polyester resin, dibasic carboxylic acid can include, for example, fumaric acid, maleic acid, succnic acid, adipic acid, suberic acid, azelaic acid, sebacic acid, terephthalic acid, isophthalic acid, 2,6-naphthenele dicarboxylic acid, n-dodecenyl succnic acid, isododecenyl succinic acid, n-dodecyl succinic acid, isododecyl succinic acid, n-octyl succinic acid, n-octenyl succinic acid and n-butyl succinic acid. Furthermore, also usable are: N,N-bis(carboxymethyl)methylamine, N,N-bis(2-carboxyethyl)methylamine, N,N-bis(2-carboxyethyl)isopropylamine, N-carboxymethyl-N-(2-carboxyethyl)methylamine, nitrotriacetic acid, N,N'-bis(carboxymethyl)piperazine, N,N'-bis(carboxyethyl)piperazine, N,N'-bis(-carboxymethyl)-2,6-dimethylpiperazine, N,N'-bis(3-carboxypropyl)piperazine and N-(2-carboxyethyl)-N'-(carboxymethyl)piperazine. These carboxylic acid ingredients are served to the esterifying reaction in the form of free acid, acid anhydride and ester.

Further, those usable as the tri or higher basic polycarboxylic acids including acid anhydrides and esters thereof are 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxylic-2-methylenecarboxyl propane, 1,3-dicarboxylic-2-methyl-2-methylenecarboxyl propane, tetra(methylenecarboxyl)methane and 1,2,7,8-octanetetracarboxylic acid.

Further, the tetracarboxylic acid can also be used as acid anhydrides and esters thereof and the following compounds (1)–(12) can be exemplified.

(1) 4-neopentyldenyl-1,2,6,7-heptane tetracarboxylic acid,
(2) 4-neopentyl-1,2,6,7-heptene(4) tetracarboxylic acid,
(3) 3-methyl-4-heptenyl-1,2,5,6-hexane tetracarboxylic acid,
(4) 3-methyl-3-heptyl-5-methyl-1,2,6,7-heptene(4) tetracarboxylic acid
(5) 3-nonyl-4-methyldenyl-1,2,5,6-hexane tetracarboxylic acid
(6) 3-decyldenyl-1,2,5,6-hexane tetracarboxylic acid,
(7) 3-nonyl-1,2,6,7-heptene(4)-tetacarboxylic acid
(8) 3-decenyl-1,2,5,6-hexane tetracarboxylic acid,
(9) 3-butyl-3-ethylenyl-1,2,5,6-hexane tetracarboxylic acid,
(10) 3-methyl-4-butyldenyl-1,2,6,7-heptane tetracarboxylic acid,
(11) 3-methyl-4-butyl-1,2,6,7-hetene(4) tetracarboxylic acid,
(12) 3-methyl-5-octyl-1,2,6,7-heptene(4)-tetracarboxylic acid.

The structural formulas of these compounds are shown below. All of them are shown in the form of acid anhydrides for convenience.

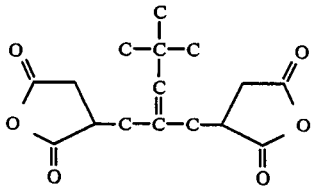
(1)

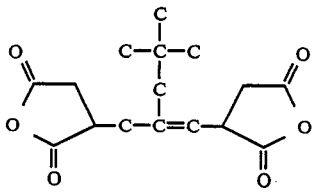
(2)

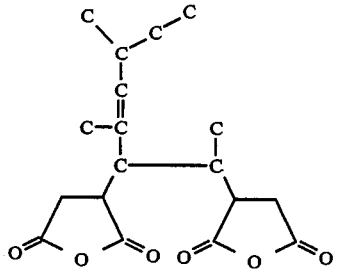
(3)

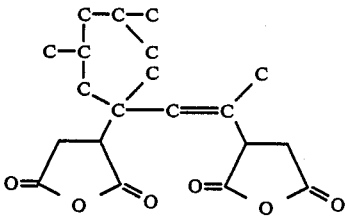
(4)

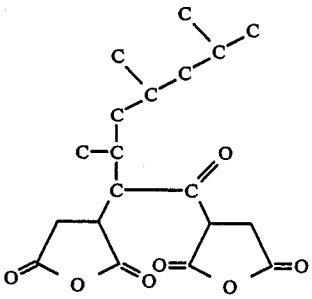
(5)

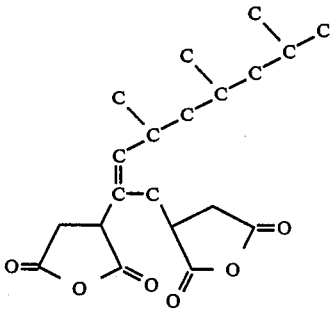
(6)

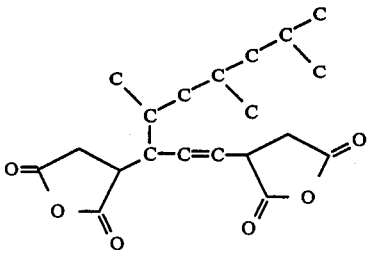
(7)

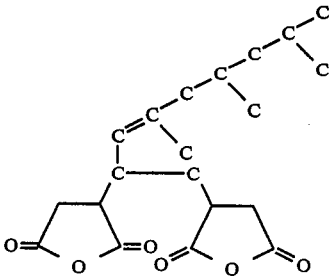
(8)

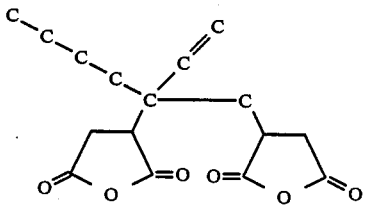
(9)

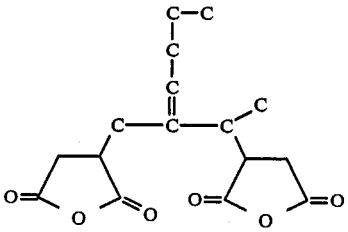
(10)

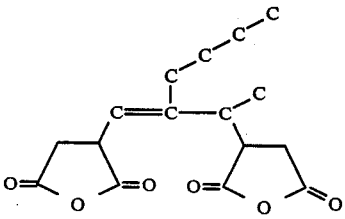
(11)

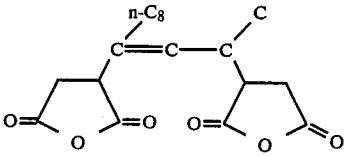
(12)

The epoxy resin usable as the binder resin in this invention can include those compounds having unsaturation bonds at two or more positions, for example, epoxides obtained from butadiene, diallyl phthalate, biscyclopentenyl ether, vinyl cyclohexene and polybutadiene; glycidyl ether of polyhydric alcohol, for example, ethylene glycol, propylene glycol and glycerine and polyglycol; glycidyl ether of polyhydric phenol, for example, 4,4'-dioxydiphenyl methane, 2,2'-bis-(4-oxyphenyl)-propane, 4,4'-dioxydiphenyl sulfone and phenol formaldehyde condensation products; and N-containing epoxides, for example, N,N-diglycidyl aniline, N,N'-dimethyl-diglycidyl aniline and N,N'-dimethyl-diglycidyl-4,4'- diaminodiphenyl methane.

Further, the epoxide resin usable in this invention may be a single epoxide, or a mixture of two or more kinds of epoxides may also be used.

Those compounds containing $NH_2$ group or NH group reactive with such epoxide compounds can include the following amine or amide type compounds. Specifically, they can include aliphatic monoamine, for example, hexyl amine, octyl amine, oleyl amine and dibutyl amine; aliphatic polyamine, for example, ethylene diamine, diethylene triamine, triethylene triamine, diethylamino propylamine and xylylene diamine; aliphatic hydroxy monoamine, for example, monoethanol amine, diethanol amine, propanol amine and N-methylethanol amine; aliphatic hydroxypolyamine, for example, such as aminoethylethanol amine, monohydroxyethyl diethylene triamine and N-(2-hydroxypropyl)ethylene diamine; cycloaliphatic monoamine, for example, aziridine, piperazine, perhydro acepine; cycloaliphatic polyamine, for example, aminoethyl piperazine, menthane diamine, 1,3-diaminocyclohexene; aromatic amine, for example, aniline, toluidine, xylidine, 4,4'-diaminodiphenyl methane, 2,2-bis(4-aminophenyl)-propane, and 4,4'-diaminodiphenyl sulfone; heterocyclic amine, for example, triazole, indole and imidazolel; monoamide, for example, propion amide, acetoanilide, benzene sulfone amide and toluene sulfone amide; polyamide amine obtained by the condensation of a dimer acid with a polyamine, for example, ethylene diamine; a so-called modified amine obtained through the reaction of an excess amount of amine type compound with an epoxide such as butyl glycidyl ether; initial condensate of polyamine with aldehyde, for example, formaldehyde or reactive derivative thereof; and initial condensate of polyamide with phenols, for example, phenol and aldehyde or reactive derivative thereof. Further, the amine type compound in this invention can include, for example, an amine complex such as $BF_3.C_2H_5$, $BF_3$. piperazine, and amine titanate, cyanoethylenic polyamine, melamine resin initial condensate, amino resin initial condensate, dicyane diamide guanidine.

The toner composition of the invention can be further improved by using a monomer such as styrene, p-chlorostyrene, p-methylstyrene, vinyl acetate, vinyl propionate, vinyl benzoate, methyl acrylate, ethyl acrylate, n-butyl acrylate, iso-butyl acrylate, dodecyl acrylate, n-octyl acrylate, methyl methacrylate, ethyl methacrylate, n-butyl methacrylate, iso-butyl methacrylate, diethylaminoethyl methacrylate, t-butylaminomethyl methacrylate, acrylonitrile, 2-vinyl pyridine, 4-vinyl pyridine, either solely or in admixture.

Further in this invention, toners with more excellent durability can be prepared by adding a polyfunctional monomer such as divinyl benzene, ethylene glycol dimethacrylate, trimethylol propane triacrylate, glycidyl methacrylate, glycidyl acrylate or the like as a cross-linking agent to the monomer as described above. The content of the polyfunctional monomer is preferably from 0.05 to 20% by weight and, more preferably, from 0.5 to 5% by weight based on the monomer.

As the polymerization initiator those generally used as oil soluble peroxide type or azo type initiators can be used. They can include, for example, benzoyl peroxide, lauroyl peroxide, 2,2'-azobisisobutyronitrile, 2,2'-azobis-(2,4-dimethylvaleronitrile), o-chloro benzoyl peroxide, o-methoxy benzoyl peroxide and the like. They are used in an amount from 0.1 to 10% by weight and, preferably, from 0.5 to 5% by weight based on the polymerizable monomer.

The suspension stabilizer usable in this invention can include a water soluble polymeric material such as gelatine, starch, hydroxyethyl cellulose, carboxymethylcellulose, polyvinyl pyrrolidone, polyvinyl alkyl ether or polyvinyl alcohol, and hardly water soluble inorganic salt such as barium sulfate, calcium sulfate, barium carbonate, calcium carbonate, magnesium carbonate or calcium phosphate, which is used in an amount from 0.1 to 5% by weight and, preferably, from 0.5 to 2% by weight based on water.

Furthermore, a low molecular weight olefin polymer known as a so-called releasing agent may be incorporated into the toners of this invention with an aim of offset-prevention, improvement in the fluidizability and fixing property.

The low molecular weight olefin polymer may preferably be incorporated together with the coloring agent for use in this invention during polymerization of the monomer.

The low molecular weight olefin polymer for use in the toners of this invention can include, for example, polyethylene, polypropylene, ethylene-vinyl acetate copolymer, chlorinated polyethylene wax, polyamide, polyester, polyurethane, polyvinyl butyral, butadiene series rubber, phenol resin, epoxy resin, rosin-modified resin, silicone oil and silicone wax.

The amount of the low molecular weight olefin polymer as described above is from 1 to 20 parts by weight and, preferably, from 3 to 15 parts by weight per 100 parts by weight of the resin ingredient in the toners. An insufficient anti-offset effect will sometimes be obtained if it is less than 1 part by weight, while gelation may undesirably occur during polymerization if the amount is more than 20 parts by weight.

For forming an image by using the toner of this invention, for example, by an electrophotographic process, there can be used a photosensitive material having, formed on an electroconductive support, a photosensitive layer containing an inorganic photoconductive material such as selenium photosensitive material, zinc oxide, cadmium sulfide, cadmium selenide, cadmium sulfoselenide, lead oxide and mercury sulfide dispersed in a binder resin, or a photosensitive material having, formed on an electroconductive support, a photosensitive layer comprising organic photoconductive material such as anthracene, polyvinyl carbazole or the like contained as required in a binder resin. The entire charging is carried out to the surface of the photosensitive layer of such a photosensitive material by means of corona discharge or the like, for example, using a corotron or scorotoron charger and then imagewise exposure is applied by way of optical rays to form electrostatic charge images. Then, the static charge images are developed with a developing agent comprising a mixture of the toners according to this invention and glass beads or iron powder carriers, for example, by a cascade process or a magnetic brush process to form toner images. The toner images are put to press-contact with a transfer paper sheet and are transferred thereon, for example, under corona discharge. The toner images thus transferred on the transfer paper sheet are heat-fixed by using a heat roll fixer coated with a releasable fluororesin or silicon rubber.

The coloring agent usable in this invention can include various types of carbon black prepared by a thermal black process, an acetylene black process, a channel black process, a furnace black process, a lamp black process and the like in the case of black toner, as well as copper phthalocyanine monoazo pigment (C.I. Pigment Red 5, C.I. Pigment Orange 36, C.I. Pigment Red 22), disazo pigment (C.I. Pigment Yellow 83), anthraquinone pigment (C.I. Pigment Blue 60), disazol dye (Solvent Red 19) and rhodamine dye (Solvent Red 49) in the case of color toner.

Further, fine magnetic powder may also be used in view of the developing mechanism or with an aim of improving the image quality. The magnetic powder can include alloys or compounds containing elements showing ferromagnetic property such as ferrite and magnetite. The magnetic material can be used while being dispersed in an amount from 30 to 70% by weight in the form of fine powder having from 0.05 to 1 μm average particle size in the binder resin.

While there are anti-offset agents, fluidizing agents and the like as the known characteristic improver contained in the toners, appropriate use of them does not hinder this invention at all.

The toner composition may be obtained by blending a binder resin, a coloring matter and the dispersant defined above. In particular this blending method is advantageous with the dispersant having the formula (V) and a vulcanizate thereof. The blending method may accompany further addition of a magnetic material, a triboelectric charging controller, an anti-offset agent and a lubricant. Cooling and pulverization follow to obtain the toner composition. The polymerization method may apply to the dispersant (V) in the same way as shown above.

The content of the compound represented by the general formula (V) and/or the vulcanizate thereof is preferably from 0.01 to 10 parts by weight based on 100 parts by weights of the binder resin. Further, the softening temperature for the electrostatic charge developing toner of the invention, measured by a flow tester, is preferably within a range of 90° and 160° C. and a glass transition point thereof is preferably higher than 50° C.

The softening point according to measurement of the flow tester can be referred to as a temperature where one half of one cm3 of a sample of the toner flows out of a nozzle having 1 mm diameter and 1 mm length by means of a plunger with a load of 20 kg/cm2, while heated at a temperature-increasing rate of 6° C./min. The flow tester used here has a tradename of "Kohkashiki" and is available from Shimazu Seisakusho.

As has been described above, since the toners for use in static charge image development according to this invention are dispersed together with a coloring agent in a monomer in admixture with a specific dispersion stabilizer and then subjected to suspension polymerization into pelletized polymer particles, toners more excellent in the dispersibility of the coloring agent than that of the toners obtained by the conventional production process can be obtained, whereby it is possible to provide toners improved not only with the blackened degree and the generation of fogging upon reproduction, but also with the developability, transfer property, fixing property and storability, as well as the manufacturing method thereof.

Examples of this invention will be shown below but it should be noted that this invention is no way limited thereto.

"Parts" in examples mean "parts by weight".

EXAMPLE 1

A mixture comprising 85 parts of styrene, 15 parts of n-butyl acrylate, 6 parts of carbon black (#44, manufactured by Mitsubishi Kasei Co.), 2 parts of calcium dodecyl benzene sulfoante and 2 parts of low molecular weight polyethylene (Mitsui High Wax 210P, manufactured by Mitsui Sekiyu Kagaku Kogyo Co.) was dispersed in a ball mill for 10 hours. After dissolving one part of 2,2'-azobisisobutyronitrile into the liquid dispersion, it was added to 250 parts of an 1% aqueous solution of polyvinyl alcohol (Gosenol GL-05, manufactured by Nihon Gosei Kagaku Kogyo Co.) and stirred in a TK homomixer (manufactured by Tokushu Kika Kogyo Co.) at 6000 an rpm for 3 minutes. When oil droplets were observed under optical microscope after stirring, the dispersibility of carbon black in the oil droplets was extremely satisfactory. The liquid suspension was subjected to polymerizing reaction in a separable flask using an ordinary stirrer at an agitating speed of 100 rpm in a nitrogen atmosphere at 75° C. for 8 hours. After completing the polymerization, centrifugal separation and water washing were repeated, followed by drying at a reduced pressure to obtain spherical toners with an average particle size of 11 μm.

To 5 parts of the toners, 95 parts of carrier iron powder (CB-100: manufactured by D. M. Stuwert Co.) were mixed to prepare a developing agent. When the images were prepared in Ricoh-FT4060 using the developing agent, clear black images with no fogging could be obtained.

COMPARATIVE EXAMPLE 1

Polymerization was carried out under the same conditions as those in Example 1 excepting that the calcium dodecylbenzene sulfonate was not added in Example 1.

Coagulation of carbon black was observed to the polymerizable mixture taken out from the ball mill and the dispersed state was poor. Although the thus resultant polymer was spherical particles of from 10 to 20 μm size, carbon black was localized in the particles, many transparent portions and transparent particles were present and the resultant powder was rather grey not black. Further, it was confirmed that carbon black was present not being taken into the particles but secured at the surface of the particles or present solely. When forming images with the toners in the same manner as in Example 1, the image density was not sufficient and fogging was resulted.

EXAMPLE 2

Toners were prepared in the same manner as in Example 1 except for using calcium stearyl benzene sulfonate instead of calcium dodecylbenzene sulfonate used in Example 1. When images were formed in the same manner as in Example 1 using the toners, clear images with no fogging having a sufficient image density could be obtained.

EXAMPLE 3

A mixture comprising 80 parts of styrene, 10 parts of n-butyl methacrylate, 10 parts of 2-ethylhexyl acrylate, 5 parts of carbon black (#30, manufactured by Mitsubishi Kasei Co.), one part of calcium octylbenzene sulfonate, and 1.5 parts of a low molecular weight polyethylene (Mitsui High Wax 4052E: manufactured by Mitsui Sekiyu Kagaku Kogyo Co.) was dispersed in a ball mill for 10 hours. After dissolving 2 parts of 2,2'-azobis-(2,4-dimethylvaleronitrile) into the liquid dispersion, it was added to 200 parts of an 1.5% aqueous solution of polyvinyl alcohol (Gosenol GM-14: manufactured by Nihon Gosei Kagaku Kogyo Co.) and stirred in a TK homomixer (manufactured by Tokushu Kika Kogyo Co.) at 7000 rpm for 3 minutes. Thereafter, spherical toners with an average particle size of 10 μm were produced in the same manner as in Example 1 and, when the images were formed by using the toners in the same manner as in Example 1, clear images with no fogging having a sufficient image density could be obtained.

EXAMPLE 4

Toners were prepared in the same manner as in Example 3 except for using magnesium dodecylbenzene sulfonate instead of calcium octylbenzene sulfonate in the same manner as in Example 3. When the images were formed in the same manner as in Example 1 by using the toners, clear images with no fogging having a sufficient image density could be obtained.

EXAMPLE 5

A mixture comprising 85 parts of styrene, 15 parts of n-butyl acrylate, 6 parts of carbon black (#44, manufactured by Mitsubishi Kasei Co.), 2 parts of basic dodecyl phenol persulfide-calcium salt and 2 parts of low molecular weight polyethylene (Mitsui High Wax 210P, manufactured by Mitsui Sekiyu Kagaku Kogyo Co.) was dispersed in a ball mill for 10 hours. After dissolving one part of 2,2'-azobisisobutyronitrile into the liquid dispersion, it was added to 250 parts of an 1% aqueous solution of polyvinyl alcohol (Gosenol GL-05, manufactured by Nihon Gosei Kagaku Kogyo Co.) and stirred in a TK homomixer (manufactured by Tokushu Kika Kogyo Co.) at 6000 an rpm for 3 minutes. When oil droplets were observed under optical microscope after stirring, the dispersibility of carbon black in the oil droplets was extremely satisfactory. The liquid suspension was subjected to polymerizing reaction in a separable flask using an ordinary stirrer at an agitating speed of 100 rpm in a nitrogen atmosphere at 75° C. for 8 hours. After completing the polymerization, centrifugal separation and water washing were repeated, followed by drying at a reduced pressure to obtain spherical toners with an average particle size of 11 μm.

To 5 parts of the toners, 95 parts of carrier iron powder (CB-100: manufactured by D. M. Stwert Co.) were mixed to prepare a developing agent. When the images were prepared in a Ricoh-FT4060 using the developing agent, clear black image with no fogging could be obtained.

COMPARATIVE EXAMPLE 2

Polymerization was carried out under the same conditions as shown in Example 5, except that the basic dodecylphenol persulfide calcium salt was not used.

Coagulation of carbon black was observed to the polymerizable mixture taken out from the ball mill and the dispersed state was poor. Although the thus resultant polymer was of spherical particles of from 10 to 20 μm in size, carbon black was localized in the particles, many transparent portions and transparent particles were present and the resultant powder was rather grey not black. Further, it was confirmed that carbon black was present not being taken into the particles but secured at the surface of the particles or solely present. When forming images with the toners in the same manner as in Example 5, the image density not sufficient and fogging was resulted.

EXAMPLE 6

Toners were prepared in the same manner as in Example 5 except for using basic stearyl phenol persulfide calcium salt instead of basic dodecylphenol persulfide-calcium salt used in Example 5. When images were formed in the same manner as in Example 5 using the toners, clear images with no fogging having a sufficient image density could be obtained.

EXAMPLE 7

A mixture comprising 80 parts of styrene, 10 parts of n-butyl methacrylate, 10 parts of 2-ethylhexyl acrylate, 5 parts of carbon black (#30, manufactured by Mitsubishi Kasei Co.), one part of basic octylphenol persulfide-calcium salt, and 1.5 parts of a low molecular weight polyethylene (Mitsui High Wax 4052E: manufactured by Mitsui Sekiyu Kagaku Kogyo Co.) was dispersed in a ball mill for 10 hours. After dissolving 2 parts of 2,2'-azobis-(2,4-dimethylvaleronitrile) into the liquid dispersion, it was added to 200 parts of an 1.5% aqueous solution of polyvinyl alcohol (Gosenol GM-14: manufactured by Nihon Gosei Kagaku Kogyo Co.) and stirred in a TK homomixer (manufactured by Tokushu Kika Kogyo Co.) at 7000 rpm for 3 minutes. Thereafter, spherical toners with an average particle size of 10 μm were produced in the same manner as in Example 1 and, when the images were formed by using the toners in the same manner as in Example 5, clear images with no fogging having a sufficient image density could be obtained.

EXAMPLE 8

Toners were prepared in the same manner as in Example 7 except for using basic alkylphenol persulfide-barium salt having an average carbon atom of 50 in the alkyl group instead of basic octylphenol persulfide-calcium salt in the same manner as in Example 7. When the images were formed in the same manner as in Example 5 by using the toners, clear images with no fogging having a sufficient image density could be obtained.

EXAMPLE 9

A mixture comprising 85 parts of styrene, 15 parts of n-butyl acrylate, 6 parts of carbon black (#44, manufactured by Mitsubishi Kasei Co.), 2 parts of an alkenyl succinic imide compound in which R represents a polybutene residue with an average molecular weight of 1260 and m=1 in the general formula (I) (referred to as compound (III)) and 2 parts of low molecular weight polyethylene (Mitsui High Wax 210P, manufactured by Mitsui Sekiyu Kagaku Kogyo Co.) was dispersed in a ball mill for 10 hours. After dissolving one part of 2,2'-azobisisobutyronitrile into the liquid dispersion, it was added to 250 parts of an 1% aqueous solution of polyvinyl alcohol (Gosenol GL-05, manufactured by Nihon Gosei Kagaku Kogyo Co.) and stirred in a TK homomixer (manufactured by Tokushu Kika Kogyo Co.) at 6000 an rpm for 3 minutes. When oil droplets were observed under optical microscope after stirring, the dispersibility of carbon black in the oil droplets was extremely satisfactory. The liquid suspension was subjected to polymerizing reaction in a separable flask using an ordinary stirrer at an agitating speed of 100 rpm in a nitrogen atmosphere at 75° C. for 8 hours.

After completing the polymerization, centrifugal separation and water washing were repeated, followed by drying at a reduced pressure to obtain spherical toners with an average particle size of 11 μm.

To 5 parts of the toners, 95 parts of carrier iron powder (CB-100: manufactured by D. M. Stuwert Co.) were mixed to prepare a developing agent. When the images were prepared in Ricoh-FT4060 using the developing agent, clear black images with no fogging could be obtained.

COMPARATIVE EXAMPLE 3

Polymerization was carried out under the same conditions as those in Example 9 excepting that the alkenyl succinic imide compound (III) was not added in Example 9.

Coagulation of carbon black was observed to the polymerizable mixture taken out from the ball mill and the dispersed state was poor. Although the resultant polymer was of spherical particles of from 10 to 20 μm in size, carbon black was localized in the particles, many transparent portions and transparent particles were present and the resultant powder was grey rather than black. Further, it was confirmed that carbon black was present not being taken into the particles but secured at the surface of the particles or present solely. When forming images with the toners in the same manner as in Example 9, the image density was not sufficient and fogging was resulted.

EXAMPLE 10

Toners were prepared in the same manner as in Example 9 except for using an alkenyl succinic imide compound in which both R and R′ represent polybutene residues with an average molecular weight of 660 and n=2 in the general formula (II) (referred to as compound (IV)) instead of the compound (III) used in Example 9. When images were formed in the same manner as in Example 9 using the toners, clear images with no fogging having a sufficient image density could be obtained.

EXAMPLE 11

A mixture comprising 80 parts of styrene, 10 parts of n-butyl methacrylate, 10 parts of 2-ethylhexyl acrylate, 5 parts of carbon black (#30, manufactured by Mitsubishi Kasei Co.), one part of an alkenyl succinic imide compound in which R represents polybutene residues with an average molecular weight of 660 and m=3 in the general formula (I) (referred to as compound (V)) and 1.5 parts of a low molecular weight polyethylene (Mitsui High Wax 4052E: manufactured by Mitsui Sekiyu Kagaku Kogyo Co.) was dispersed in a ball mill for 10 hours. After dissolving 2 parts of 2,2′-azobis-(2,4-dimethylvaleronitrile) into the liquid dispersion, it was added to 200 parts of an 1.5% aqueous solution of polyvinyl alcohol (Gosenol GM-14: manufactured by Nihon Gosei Kagaku Kogyo Co.) and stirred in a TK homomixer (manufactured by Tokushu Kika Kogyo Co.) at 7000 rpm for 3 minutes. Thereafter, spherical toners with an average particle size of 10 μm were produced in the same manner as in Example 9 and, when the images were formed by using the toners in the same manner as in Example 9, clear images with no fogging having a sufficient image density could be obtained.

EXAMPLE 12

Toners were prepared in the same manner as in Example 11 except for using an alkenyl succinic imide compound in which R represents polybutene residues with an average molecular weight of 2350 and m=3 in the general formula (I) (referred to as compound (VI)) instead of the compound (V) in the same manner as in Example 11. When the images were formed in the same manner as in Example 9 by using the toners, clear images with no fogging having a sufficient image density could be obtained.

EXAMPLE 13

A mixture comprising 85 parts of styrene, 15 parts of n-butyl acrylate, 6 parts of carbon black (#44, manufactured by Mitsubishi Kasei Co.), 2 parts of calcium lauryl salicylate persulfide-calcium salt and 2 parts of low molecular weight polyethylene (Mitsui High Wax 210P, manufactured by Mitsui Sekiyu Kagaku Kogyo Co.) was dispersed in a ball mill for 10 hours. After dissolving one part of 2,2′-azobisisobutyronitrile into the liquid dispersion, it was added to 250 parts of a 1% aqueous solution of polyvinyl alcohol (Gosenol GL-05, manufactured by Nihon Gosei Kagaku Kogyo Co.) and stirred in a TK homomixer (manufactured by Tokushu Kika Kogyo Co.) at 6000 an rpm for 3 minutes. When oil droplets were observed under optical microscope after stirring, the dispersibility of carbon black in the oil droplets was extremely satisfactory. The liquid suspension was subjected to polymerizing reaction in a separable flask using an ordinary stirrer at an agitating speed of 100 rpm in a nitrogen atmosphere at 75° C. for 8 hours. After completing the polymerization, centrifugal separation and water washing were repeated, followed by drying at a reduced pressure to obtain spherical toners with an average particle size of 11 μm.

To 5 parts of the toners, 95 parts of carrier iron powder (CB-100: manufactured by D. M. Stuwert Co.) were mixed to prepare a developing agent. When the images were prepared in a Ricoh-FT4060 using the developing agent, clear black image with no fogging could be obtained.

COMPARATIVE EXAMPLE 4

Polymerization was carried out under the same conditions as those in Example 13 except that the calcium lauryl salicylate was not added.

Coagulation of carbon black was observed to the polymerizable mixture taken out from the ball mill and the dispersed state was poor. Although the resultant polymer was of spherical particles of from 10 to 20 μm in size, carbon black was localized in the particles, many transparent portions and transparent particles were present and the resultant powder was grey rather than black. Further, it was confirmed that carbon black was present not being taken into the particles but secured at the surface of the particles or present solely. When forming images with the toners in the same manner as in Example 13 the image density was not sufficient and fogging was resulted.

EXAMPLE 14

Toners were prepared in the same manner as in Example 13 excepting for calcium stearyl salicylate salt instead of the calcium lauryl salicylate used in Example 13. When images were formed in the same manner as in Example 13 using the toners, clear images with no fogging having a sufficient image density could be obtained.

EXAMPLE 15

A mixture comprising 80 parts of styrene, 10 parts of n-butyl methacrylate, 10 parts of 2-ethylhexyl acrylate, 5 parts of carbon black (#30, manufactured by Mitsubishi Kasei Co.), one part of calcium octyl salicylate, and 1.5 parts of a low molecular weight polyethylene (Mitsui High Wax 4052E: manufactured by Mitsui Sekiyu Kagaku Kogyo Co.) was dispersed in a ball mill for 10 hours. After dissolving 2 parts of 2,2'-azobis-(2,4-dimethylvaleronitrile) into the liquid dispersion, it was added to 200 parts of an 1.5% aqueous solution of polyvinyl alcohol (Gosenol GM-14: manufactured by Nihon Gosei Kagaku Kogyo Co.) and stirred in a TK homomixer (manufactured by Tokushu Kika Kogyo Co.) at 7000 rpm for 3 minutes. Thereafter, spherical toners with an average particle size of 10 μm were produced in the same manner as in Example-13 and, when the images were formed by using the toners in the same manner as in Example 13, clear images with no fogging having a sufficient image density could be obtained.

EXAMPLE 16

Toners were prepared in the same manner as in Example 15 except for using magnesium alkyl salicylate having an average carbon atom of 50 in the alkyl group instead of the calcium octyl salicylate in the same manner as in Example 15. When the images were formed in the same manner as in Example 13 by using the toners, clear images with no fogging having a sufficient image density could be obtained.

EXAMPLE 17

| | |
|---|---|
| Copolymer of styrene, 2-ethylhexyl acrylate and t-butylmethacrylate (80:15:5 weight ratio) (dry bulb softening point 124° C.) | 90 parts by weight |
| Carbon black (Ravan 100: manufactured by Columbian Carbon Co) | 10 parts by weight |
| Charge controller (Vositron S31: manufactured by Orient Chemical Co.) | 2 parts by weight |
| Compound (V-2) | 1 part by weight |

were melted and kneaded and then pulverized and classified obtain toners with 11.5 μm average particle size. 80 g of the toners were mixed with 2 kg of ferrite type coat carrier to prepare a developer. When preparing an image in a commercial copying machine (copy speed at 45 sheet/min) clear image at high quality with no fogging could be obtained. Furthermore, no generation of fogging was recognized and high quality images with no change in the initial image quality could be obtained even after the reproduction of 20,000 sheets. Furthermore no disadvantage such as abnormality in the image density occurred even under a high humidity condition (85% RH, 35° C.).

COMPARATIVE EXAMPLE 5

The toners were prepared under the same conditions as those in Example 17 except for excluding the compound (V-2) to obtain toners with 11.5 μm average particle size and also having substantially the same particle size distribution. When a developer was prepared from 80 g of the toners and 2 kg of the same carrier as that used in Example 17 for making images, clear images with no fogging could be obtained. However, the toners scattered from the developing device at the reproduction of 10,000 sheets and fogging occurred in the images. The image density was abnormally high, partial blanking was generated and background stains were recognized under a highly humid condition (85% RH, 35° C.).

EXAMPLE 18

2800 g of polyoxypropylene (2,2-)-2,2-bis(4-hydroxyphenyl)propane, 650 g of polyoxyethylene (2,0)-2,2-bis(4-hydroxyphenyl) propane, 839 g of terephthalic acid, 384 g of trimellitic anhydride, 536 g of n-dodecenyl succinic anhydride, 500 g of carbon black (REGAL 400R manufactured by Cabot Co.) and 50 g of the compound (V-1) were charged in a 10 liter four-necked flask. A thermometer, a stainless steel agitation rod, a flowing condenser and a nitrogen introduction tube were attached and reaction was conducted at 200° C. under stirring in an electrically heated mantle under a nitrogen gas stream. The polymerization degree was observed depending on the softening point according to ASTM E28-51T and the reaction was terminated when the softening point reached 120° C. The black resin thus prepared was pulverized and classified to obtain toners of 12 μm average particle size. The softening point of the toners measured by the flow tester was 125° C. Further, the glass transition point (Tg) measured by DSC (differential calorimeter) was 58° C. 60 g of the toners were mixed with 2 kg of ferrite coat carrier to prepare a developer. When images are prepared by using the developer in a commercial copying machine in the same manner as in Example 17, clear images at high blackness with no fogging could be obtained.

COMPARATIVE EXAMPLE 6

Toners were prepared in the same procedures as those in Example 18 excepting for excluding the compound (V-1) to obtain toners poor in the blackness. When images were prepared by using the toners in the same manner as in Example 18, the images obtained were not clear with insufficient density.

EXAMPLE 19

850 g of styrene, 60 g of 2-hydroxyethyl methacrylate, 90 g of n-butyl acrylate, 100 g of carbon black (#44: manufactured by Mitsubishi Kasei) and 10 g of the vulcanizate of the compound (V-2) were charged in a ball mill and, after stirring for 2 hours, 10 g of 2,2-(azobisisobutylonitrile) was admixed. 500 g of xylene was charged to a reactor equipped with a stirrer, a nitrogen introducing tube, a thermometer, a refluxing cooling tube and a dropping funnel, and the temperature was set to 80° C. The liquid mixture was dropped under a nitrogen gas stream and polymerized for 4 hours. After the dropping was completed, it was aged for about 10 hours at the same temperature and then the temperature was gradually increased to 200° C. and the pressure was reduced to 2 mmHg to remove xylene and then allowed to cool to soridify. The thus obtained black solids were pulverized and classified to prepare toners of 12 μm in average particle size. 60 g of the toners were mixed with the same ferrite coat carrier as in Example 17 to prepare a developer. When images were prepared in a commercial copying machine, clear images at high quality with no fogging could be obtained. No degradation in the images was recognized even after printing for 10,000 sheets.

COMPARATIVE EXAMPLE 7

Toners were prepared quite in the same procedures as those in Example 19 excepting for excluding the vulcanizate of the compound (V-2). The thus obtained toners were poor in the blackness and the density of the images was too low and did not attain the actually usable level.

EXAMPLE 20

Toners were prepared quite in the same procedures as in Example 18 excepting for using 350 g of phthalocyanine type pigment (Sumitone Cyanine Blue-HBA: C.I. Pigment No. 15) in pace of 500 g of carbon black. When images were prepared quite under the same procedures as in Example 18, clear blue images with no background fogging could be obtained.

As apparent from the foregoing results, the toner according to this invention is excellent in the chargeability and has preferred initial images, as well as printing-resistance and circumstance-proofness of the images were excellent.

The embodiments of the invention in which an exclusive property or privilege is claimed are defined as follows:

1. An electrophotographic toner composition prepared by a process which comprises:

(1) dispersing carbon black and a dispersant compound in a polymer binder having a polymerizable unsaturation so as to produce an oil phase, said dispersant compound being soluble in said polymer binder, said dispersant compound being selected from at least one member of the group consisting of (a) a sulfonate compound having the formula (I),

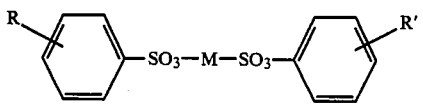

(I)

wherein R and R', which may be identical or different, individually represents linear or branched alkyl groups having from 6 to 50 carbon atoms, and M represents an alkaline earth metal, (b) an alkaline earth metal salt of a basic alkylphenol persulfide having the formula (II),

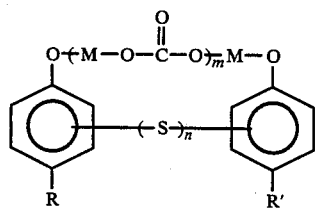

(II)

wherein R and R', which may be identical or different, individually represents linear or branched alkyl groups having from 6 to 100 carbon atoms, M represents an alkaline earth metal, S represents a sulfur atom, m=0–5 and n=1–3, (c) an alkyl or alkenyl succinic acid imide having the formula (III-1) or (III-2),

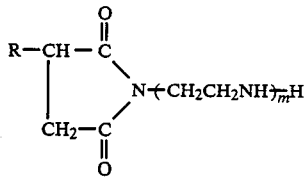

(III-1)

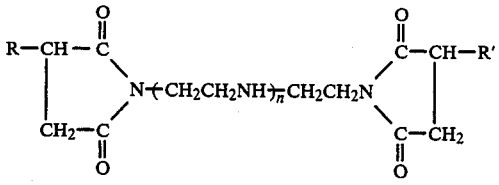

(III-2)

wherein R and R', which may be identical or different, individually represents linear or branched alkyl or alkenyl groups having from 12 to 300 carbon atoms and m, n individually represents integers from 0 to 10, (d) an alkyl salicylic acid salt having the formula (IV),

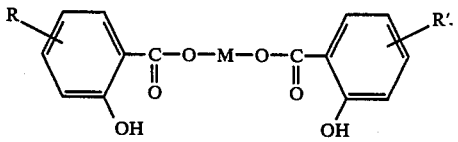

(IV)

wherein R and R', which may be identical or different, individually represents linear or branched alkyl groups having from 6 to 100 carbon atoms and M represents an alkaline earth metal, and (e) a compound having formula (V), and a reaction product obtained by treating compound (V) with sulfur

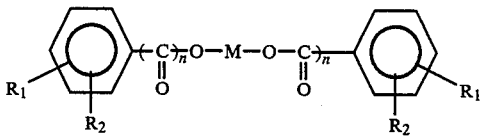

(V)

in which at least one of R1 and R2 is an alkyl group, an alkenyl group, an aryl group, an arylalkyl group or an alkylaryl group, having 1 to 32 carbon atoms, the other is a hydroxy or hydrogen, n is zero or 1 and M is an alkaline earth metal or a divalent transition metal; and (2) polymerizing the dispersed oil phase by suspension polymerization to obtain dry toner particles.

2. The toner composition as claimed in claim 1, in which said compound has the formula (I), (II), (III-1), (III-2) or (IV).

3. The toner composition as claimed in claim 1, which comprises 100 parts by weight of the binder polymer and 0.01 to 10 parts by weight of said compound having the formula.

4. The toner composition as claimed in claim 1, which has a softening point of 90° to 160° c. according to a flow tester and a glass transition temperature of 50° c. or higher.

5. A process for producing a toner composition, which comprises:

(1) dispersing carbon black and a dispersant compound in a polymer binder having a polymerizable unsaturation so as to produce an oil phase, said dispersant compound being soluble in said polymer binder, said dispersant compound being selected from at least one member of the group consisting of (a) a sulfonate compound having the formula (I),

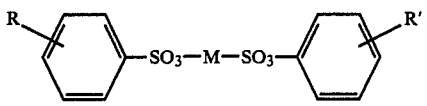

(I)

wherein R and R', which may be identical or different, individually represents linear or branched alkyl groups having from 6 to 50 carbon atoms, and M repesents an alkaline earth metal, (b) an alkaline earth metal salt of a basic alkylphenol persulfide having the formula (II),

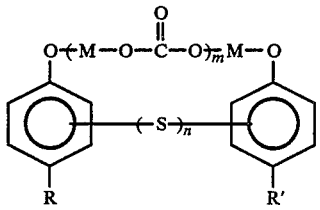

(II)

wherein R and R', which may be identical or different, individually represents linear or branched alkyl groups having from 6 to 100 carbon atoms, M represents an alkaline earth metal, S represents a sulfur atom, m=0–5 and n=1–3, (c) an alkyl or alkenyl succinic acid imide having the formula (III-1) or (III-2),

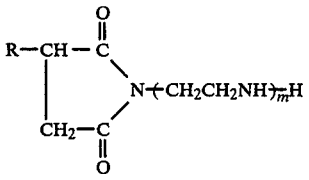

(III-1)

-continued

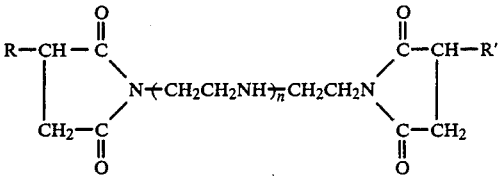

(III-2)

wherein R and R', which may be identical or different, individually represents linear or branched alkyl or alkenyl groups having from 12 to 300 carbon atoms and m, n individually represents integers from 0 to 10, (d) an alkyl salicylic acid salt having the formula (IV),

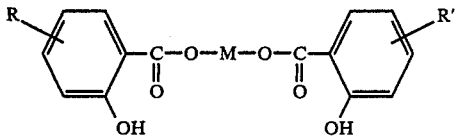

(IV)

wherein R and R', which may be identical or different, individually represents linear or branched alkyl groups having from 6 to 100 carbon atoms and M represents an alkaline earth metal, and (e) a compound having formula (V), and a reaction product obtained by treating compound (V) with sulfur

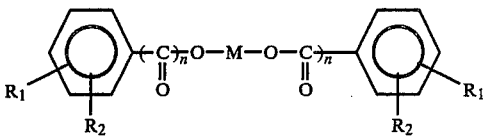

(V)

in which at least one of R1 and R2 is an alkyl group, an alkenyl group, an aryl group, an arylalkyl group or an alkylaryl group, having 1 to 32 carbon atoms, the other is a hydroxy or hydrogen, n is zero or 1 and M is an alkaline earth metal or a divalent transition metal; and (2) polymerizing the dispersed oil phase by suspension polymerization.

6. The process as claimed in claim 5, in which said compound has the formula (I), (II), (III-1), (III-2) or (IV).

7. The process as claimed in claim 5, in which said compound is present in an amount of 0.5 to 10 percent by weight per the monomer.

8. The process of claim 5, further comprising the steps of preparing an oil phase dispersion from the polymer binder, carbon black and the dispersant compound and adding the oil phase dispersion to an aqueous phase containing therein a dispersion stabilizer, at a weight ratio of 1:2 to 1:10, to form drops of from 5 to 30 microns.

* * * * *